US005249940A

United States Patent [19]

Matsuda et al.

[11] Patent Number: 5,249,940

[45] Date of Patent: Oct. 5, 1993

[54] SCROLL COMPRESSOR HAVING A MAGNET PRESSING THE MOVING SCROLL MEMBER AXIALLY

[75] Inventors: Mikio Matsuda, Okazaki; Kazuhide Uchida, Nishio; Mitsuo Inagaki, Okazaki; Yasuhiro Oki, Toyota, all of Japan

[73] Assignee: Nippon Soken, Inc., Nishio, Japan

[21] Appl. No.: 873,186

[22] Filed: Apr. 24, 1992

[30] Foreign Application Priority Data

Apr. 26, 1991 [JP] Japan ..... 3-96988

[51] Int. Cl.[5] ..... F04C 18/04

[52] U.S. Cl. ..... 418/55.5; 418/57

[58] Field of Search ..... 418/55.3, 55.5, 57

[56] References Cited

U.S. PATENT DOCUMENTS

| | | | |
|---|---|---|---|
| 4,435,137 | 3/1984 | Terauchi | 418/55.5 |
| 4,457,676 | 7/1984 | Hiraga | 418/55.5 |
| 4,650,405 | 3/1987 | Iwanami et al. | 418/5 |
| 5,165,878 | 11/1992 | Inagaki et al. | 418/55.3 |
| 5,167,494 | 12/1992 | Inagaki et al. | 418/55.3 |

OTHER PUBLICATIONS

Inagaki et al Application No. 07/477,463.

*Primary Examiner*—John J. Vrablik

*Attorney, Agent, or Firm*—Cushman, Darby & Cushman

[57] ABSTRACT

In a scroll compressor, the moving scroll member is engaged with the stationary scroll member while centrally offset from each other so that they define an actuation chamber between them. When driven by the crank of the compressor shaft and blocked against rotation by the rotation restricting plate, the moving scroll member revolves to compress the fluid in the actuation chamber, and because of the relationship between the compression reaction force and the driving force, a moment is produced to incline the moving scroll member, so that the moving scroll member rises at a portion of the thrust bearing plate, the contact pressure between the scroll members is increased, and a larger driving force is required. Accordingly, the attraction force of the magnet and magnetic body is utilized to press the moving scroll member against the thrust bearing plate. This force can be generated due to the attracting force or repulsing force between magnets, or by the force of a spring. Therefore, according to the present invention, the tooth width of both scroll members can be made larger.

14 Claims, 13 Drawing Sheets

$P_d/P_s = 26/4$ (kg/cm²)

SCROLL COMPRESSOR HAVING A MAGNET PRESSING THE MOVING SCROLL MEMBER AXIALLY

BACKGROUND OF THE INVENTION

Field of the Invention

The preset invention relates to a scroll compressor able to be used, for example, as a refrigerant compressor for an automobile air-conditioner.

Description of the Related Art

Generally, in the conventional scroll compressor, the axial length (tooth width) of the moving and stationary scroll members 100 and 101 cannot be made longer than shown in FIG. 13, and accordingly, the radial size of the scroll members 100 and 101 must be increased to ensure a necessary discharge of the compressor. Therefore, the conventional scroll compressor is disadvantageous in that the overall outside diameter thereof becomes so large that the compressor must occupy a relatively wide space in an engine room when used as a refrigerant compressor in an automobile air-conditioner.

In the scroll compressor shown in FIG. 13, when the moving scroll member 100 is revolved in a predetermined direction, the refrigerant in the actuation chamber 102 will be compressed, and accordingly, a reaction force $F_1$ caused by this compression will be applied to the moving scroll member 100. Namely, the crank 114 must displace the moving scroll member 100 with a force $F_2$ corresponding to the reaction force $F_1$ applied to the moving scroll member 100. Since the reaction force $F_1$ and driving force $F_2$ act in different directions from each other, however, a moment will occur before (incline) the moving scroll member 100 can be rotated. This angular moment is caused by the reaction forces $X_1$ and $X_2$ applied to the thrust bearing members 104 and 105, and in this case, the sum of the thrust reaction forces $X_1$ and $X_2$ will be equal to a force $X_3$ exerted by the refrigerant in the actuation chamber 102 on the moving scroll member 100.

The pressing force $X_3$ is substantially constant in accordance with the volume of the actuation chamber 102. As shown in FIG. 14, however, when the moment caused by reaction force $F_1$ and driving force $F_2$ becomes very large, the moment caused by the bearing capacities $X_1$ and $X_2$ must be equal to the moment caused by the forces $X_1$ and $X_2$, and thus a force cannot be generated that will press the moving scroll member 100 toward the bearing 105. As a result, the moving scroll member 100 comes into contact with the stationary scroll member 101 and a reaction force $X_2$ will develop at the point of contact of the moving scroll member 100 with the stationary scroll member 101. Namely, the moving scroll member 100 is inclined with respect to the axis of the crank 114, and thus a part thereof will be separated from the bearing member 105.

Accordingly, when the moving scroll member 100 starts to revolve while in contact with the stationary scroll member 101, the contact pressure between the moving and stationary scroll member 100 and 101 becomes so great that the driving force required for rotating the moving scroll member 100 will become larger than necessary, and therefore the durability of the moving and stationary scroll members 100 and 101 will be lowered, and further, since the moving scroll member 100 is inclined, a leakage of the refrigerant from between the moving and stationary scroll members 100 and 101 may occur. Therefore, the moving and stationary scroll members 100 and 101 in the conventional scroll compressor cannot be designed to have shapes, respectively, such that the moment caused by the reaction force $F_1$ and driving force $F_2$ will become too large, and thus the moving and stationary scroll members 100 and 101 must be designed to have a reduced axial length (tooth width).

SUMMARY OF THE INVENTION

A primary object of the present invention is to provide a scroll compressor in which, even if the scroll tooth width of the moving and stationary scroll members is large, the moving scroll member will not be forced away from the thrust bearing members by the compression reaction force.

Another object of the present invention is to provide a scroll compressor in which, even if the scroll tooth width of the moving and stationary scroll members is large, the moving scroll member will not be inclined by the compression reaction force, whereby an increase of the sliding contact friction between the addenda of the moving and stationary scroll members can be prevented to thereby ensure an increased driving force and reduced friction.

Still another object of the present invention is to provide a scroll compressor in which the scroll tooth width is larger than that of the conventional scroll compressor but provides a same discharge as that of the conventional scroll compressor, although smaller in overall size and having a smaller diameter than the conventional scroll compressor.

The above objects are attained, according to the present invention, by providing a scroll compressor comprising a housing with inlet and outlet ports, a stationary scroll member including a spiral body formed on an end plate thereof and fixed inside the housing, a moving scroll member including a spiral body formed on an end plate thereof and assembled so that it is in mesh with but offset from the stationary scroll member, a front housing integrally mounted to cover an opening of the housing, a shaft rotatably supported in the front housing, having a crank offset by a predetermined amount from the center thereof and imparting a revolving movement to the moving scroll member, a detent mechanism allowing only a revolving and inhibiting a rotation of the moving scroll member, thrust bearing members restricting a displacement of the moving scroll member in a direction away from the stationary scroll member, and a means of pressing the moving scroll member against the thrust bearing members.

The above-mentioned construction of the scroll compressor according to the present invention enables the moving scroll member to be stably forced against the thrust bearing members, thereby preventing an inclination and separation of the moving scroll member from a portion of the thrust bearing members, and accordingly, preventing a contact thereof with the stationary scroll member under a large bearing pressure.

These and other objects and advantages of the present invention will be better understood from the ensuring description made, by way of example, of the embodiments of the present invention, with reference to the drawings.

DESCRIPTION OF THE PREFERRED EMBODIMENTS

Figure 1:
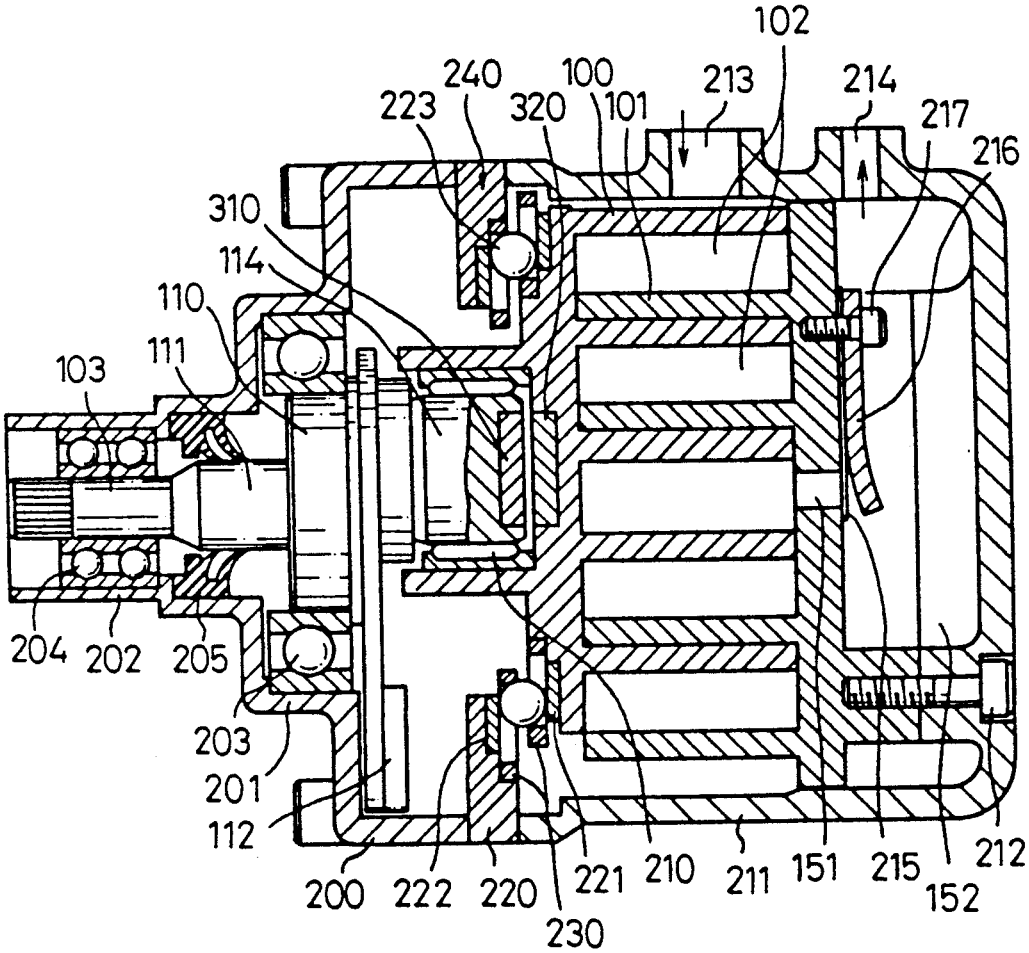
FIG. 1 is a sectional view of one embodiment of the compressor according to the present invention.

The embodiments of the compressor according to the present invention will be discussed in further detail with reference to the drawings. In FIG. 1, reference numeral 200 indicates a front housing made of an aluminum alloy having stepped cylindrical portions 201 and 202 in which bearings 203 and 204 are retained, respectively. Also, a shaft 103 having a small-diameter portion and a large-diameter portion 110 is provided in the front housing 200. The small-diameter portion of the shaft 103 is rotatably supported in the bearing 204, and the large-diameter portion 110 is rotatably supported in the bearing 203. The shaft 103 further comprises a middle-diameter portion 111 having disposed on the outer circumference thereof a shaft seal 205 for preventing a leakage of the refrigerant and lubricant within the compressor along the shaft 103. The shaft 103 has integrally formed therewith a crank 114 on which a magnet 310 is fixed by bonding with an epoxy resin, etc. The crank 114 is offset by a predetermind amount from the center of the axis of rotation of the shaft 103. Also a counterweight 112 is fixed on the shaft 103 to compensate for the eccentricity of the moving scroll member 100.

The moving scroll member 100 is rotatably engaged on the crank 114 by a bearing 210, and thus the moving scroll member 100 is revolved within a rear housing 211 by the rotation of the crank 11.4 Also the moving scroll member 100 has a magnetic plate 320 attached to the surface thereof opposite to the magnet 310. The rear housing 211 has the stationary scroll member 101 fixed thereto with a bolt 212, and an inlet port 213 and outlet port 214 opened therein. The inlet port 213 and outlet port 214 are isolated from each other by the stationary scroll member 101. As shown, the outer space of the stationary scroll member 101 serves as inlet pressure space and the space to the right of the stationary scroll member 101 serves as a delivery pressure space. The stationary scroll member 101 has fixed thereto a delivery valve 215 having a valve cover 216, by a bolt 217.

Disposed between the front and rear housings 200 and 211 is a thrust bearing plate 220 having a second bearing plate 222 made of a bearing steel fixed to the surface thereof opposite to the moving scroll member 100. The moving scroll member 100 has a first bearing plate 221 made of a bearing steel fixed to the surface thereof opposite to the thrust bearing plate 220, in the same way as the thrust bearing plate 220. The first and second bearing plates 221 and 222 have steel balls 223 disposed therebetween.

Figure 2:
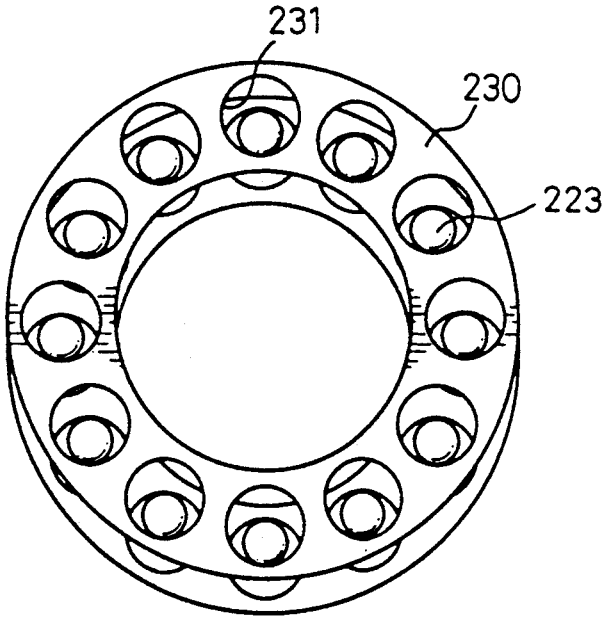
FIG. 2 is a side elevation of the rotation restricting disc assembly in FIG. 1.
Figure 3A:
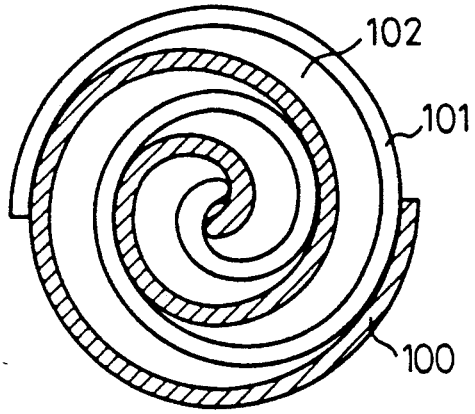
FIGS. 3(*a*) to 3(*d*) are explanatory drawings showing the operating states of the actuation chamber in the compressor in FIG. 1.
Figure 3B:
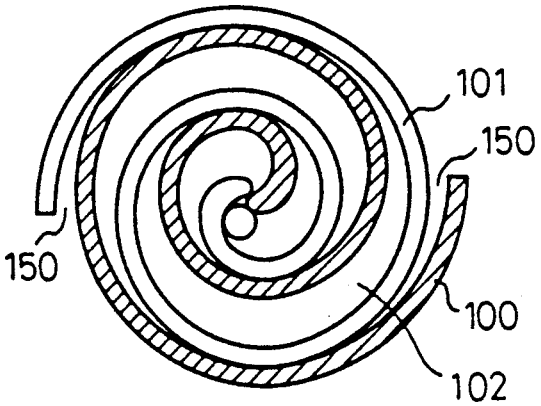
Figure 3C:
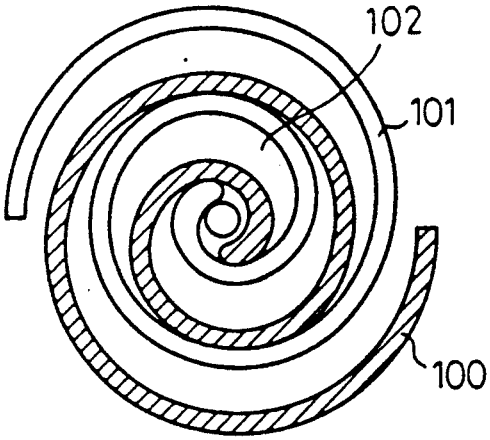
Figure 3D:
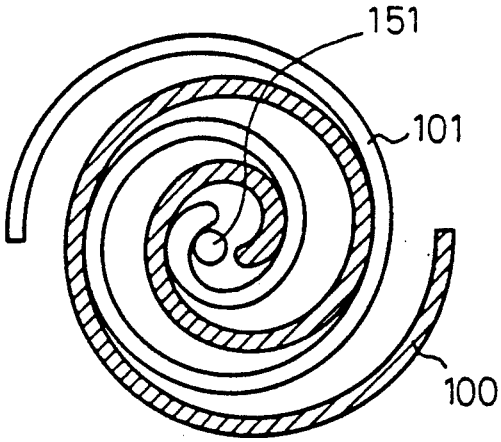

The steel balls 223 are retained by a rotation restricting disc assembly 230 as shown in FIG. 2. The rotation restricting disc assembly 230 consists of a pair of discs for retaining the steel balls 223, each of the discs having formed therein retaining holes 231 having a diameter corresponding to the radius of revolution of the moving scroll member 100.

The compressor constructed as above functions as described herebelow:

First, a rotation driving force of a car engine is transmitted to the shaft 103 by an electromagnetic clutch (not shown) disposed on the outer surface of the cylindrical portion 202 of the front housing 200. When supplied with the driving force, the shaft 103 rotates about the axis of rotation inside the front housing 200, and since the crank 114 is centrally offset by a predetermined amount from the axis of rotation of the shaft 103, the moving scroll member 100 revolves inside the rear housing 211. At this time, the moving scroll member 100 is prevented from rotating by the engagement between the pair of rotation restricting discs 230 and the steel balls 223.

FIGS. 3(*a*) to 3(*d*) show the revolving movements of the moving scroll member 100. As the moving scroll member 100 revolves, the volume of the actuation chamber 102 defined between the moving and stationary scroll members 100 and 101 is alternately increased and decreased, and since the outside of the moving scroll member 100 is an inlet pressure space, the refrigerant is sucked from the space 150 between the moving and stationary scroll members 100 and 101 into the actuation chamber 102. Next, as the volume of the actuation chamber 102 decreases, the refrigerant is compressed, and when the pressure of the thus-compressed refrigerant becomes higher than a predetermined pressure, the refrigerant is delivered from the delivery port 151 through the delivery valve 215 open at this time to a delivery chamber 152. Regarding the compressor, when the moving scroll member 100 has rotated about 2.2 times, the compression is completed. Then the high pressure refrigerant delivered into the delivery chamber 152 is delivered from the delivery port 214 toward a condenser (not shown) of the refrigerating cycle.

Figure 4:
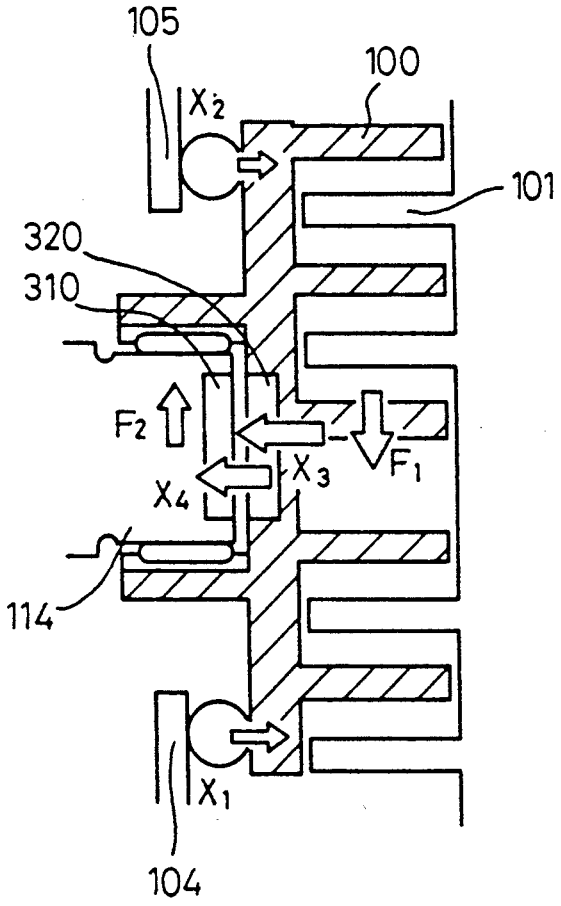
FIG. 4 is an explanatory drawing showing the compression reaction force and driving force, etc., in the compressor shown in FIG. 1.

The compression of the refrigerant in the actuation chamber 102 causes a compression reaction force $F_1$ in the moving scroll member 100, and a driving force $F_2$ corresponding to this reaction force $F_1$ will develop in the crank 144 as shown in FIG. 4. In this compressor, since the scroll tooth width of the moving and stationary scroll members 100 and 101 is set to be as relatively large as about 35 mm, the angular moment caused by the reaction force $F_1$ and driving force $F_2$ is also large.

This angular moment is received by reaction forces $X_1$ and $X_2$ applied to the thrust bearing members 104 and 105, and the sum of the thrust forces $X_1$ and $X_2$ is equal to the sum of a pressing force $X_3$ with which the refrigerant in the actuation chamber 102 presses against the moving scroll member 100 and a force $X_4$ with which the magnet 310 attracts the magnetic plate 320.

Figure 5:
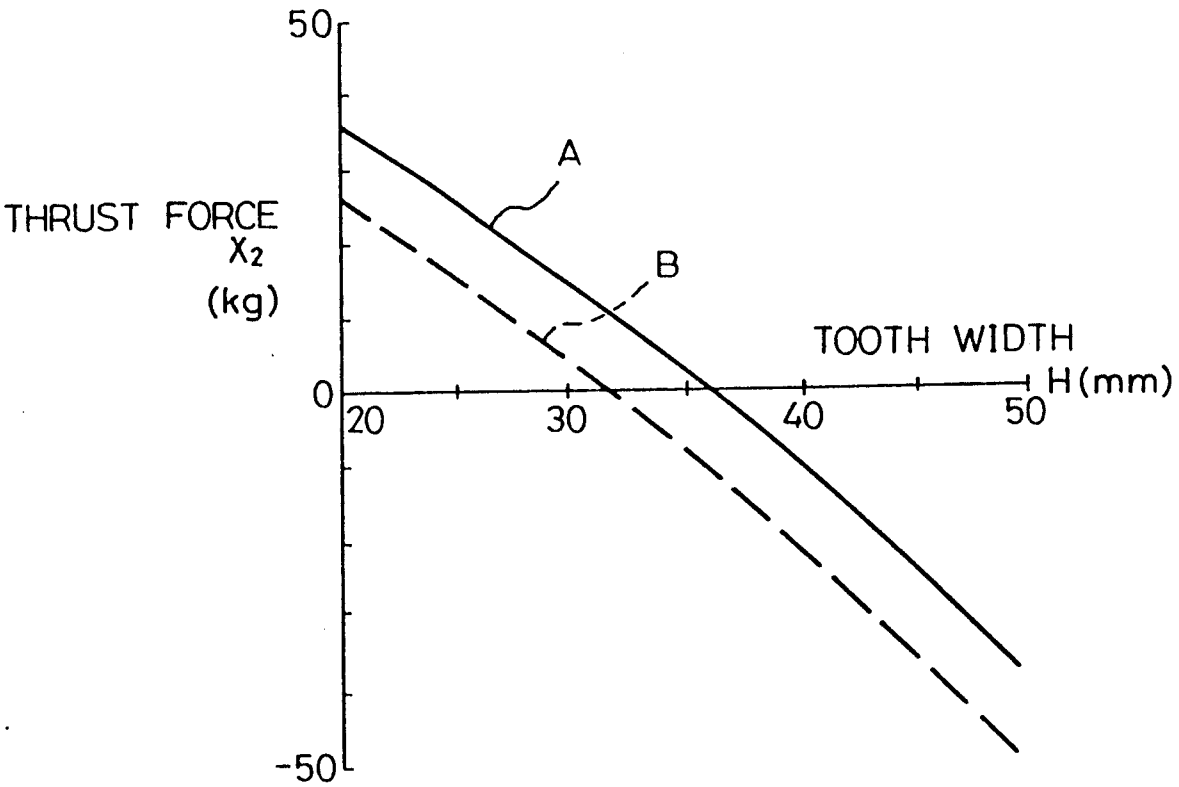
FIG. 5 is an explanatory drawing showing the effect of the present invention.

The effect of the present invention is shown in FIG. 5. As shown in the figure, the horizontal axis indicates the tooth width of the moving and stationary scroll members 100 and 101, and the vertical axis indicates the thrust force $X_2$. The solid line A in FIG. 5 relates to the compressor according to the present invention, and the dash line B relates to the conventional compressor. In the conventional compressor, the attracting force $X_4$ due to the magnet 310 does not develop, and thus the thrust force $X_2$ becomes positive. To ensure that the moving scroll member 100 is not pulled away from the thrust bearing member 240, the scroll tooth width must be about 32 mm or less. Conversely, this embodiment of the present invention adopts a powerful magnet 310 made of a material containing a rare earth, which can generate an attracting force of about 20 kgf, and therefore, the scroll tooth width can be set as large as 35 mm or more, as indicated by the intersection of the solid line A with the horizontal axis in FIG. 5. As a result, the radial length of the moving and stationary scroll members 100 and 101 can be reduced, and further, the outside diameter of the front and rear housings 200 and 211 can be reduced to about 105 mm, which is about 90% of that (118 mm) in the conventional compressor.

Figure 6:
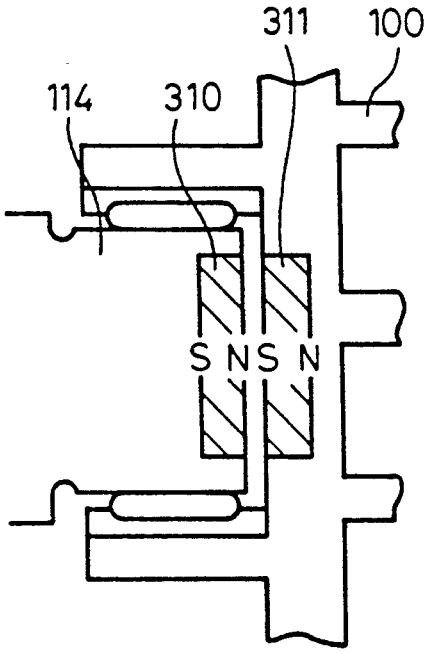
FIG. 6 is a fragmentary sectional view showing other embodiments of the magnet and magnetic plate in the compressor shown in FIG. 1.

In the above-mentioned embodiment, the magnet 310 is fixed to the crank 114 and the plate 320 is fixed to the moving scroll member 100, but the plate 320 may be fixed to the crank 114 and the magnet 310 fixed to the moving scroll member 100. Further, as shown in FIG. 6, first and second magnets 310 and 311, which cause the polarities of the opposite surfaces to be opposite to each other, may be fixed to both the crank 114 and moving scroll member 100.

Figure 7:
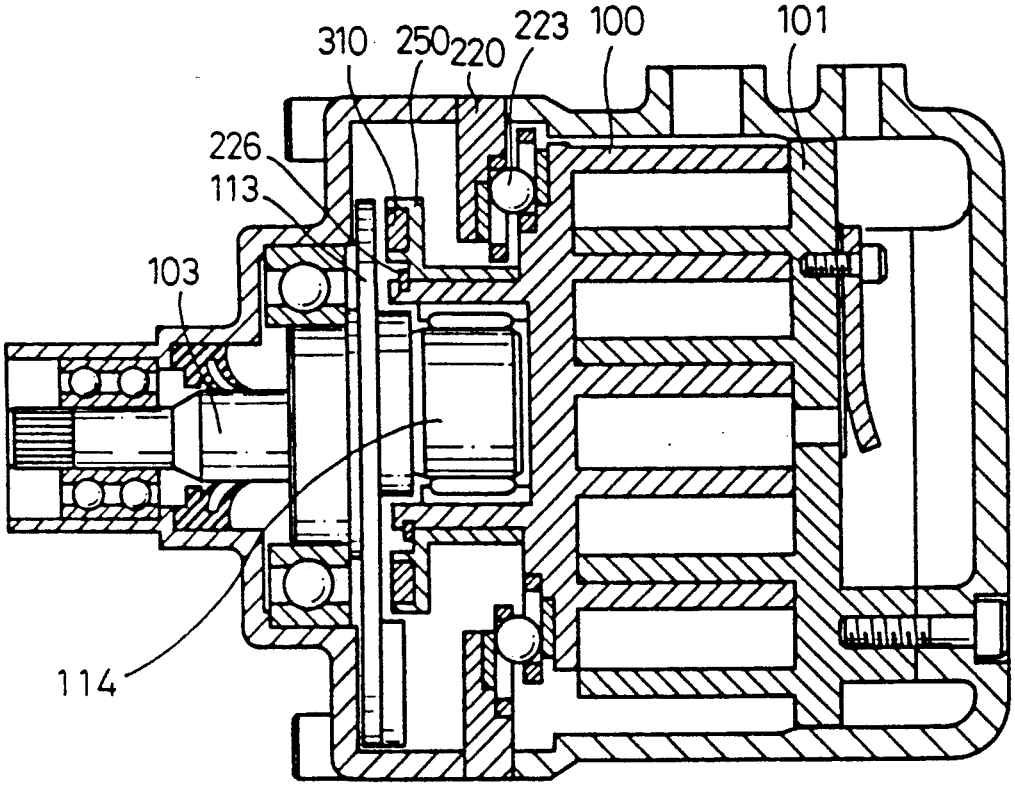
FIG. 7 is a sectional view showing a second embodiment of the compressor according to the present invention.

FIG. 7 shows a second embodiment of the present invention. In this second embodiment, a holder 250 is removably fixed to the moving scroll member 100 by a clip 226. An annular magnet 310 is fixed to the holder 250 so as to be opposite to a magnetic flange 113 formed on the shaft 103, thereby assuring the same effect as that of the first embodiment. The remaining structure of the second embodiment is the same as that of the first embodiment, and thus will not be discussed further.

Figure 8:
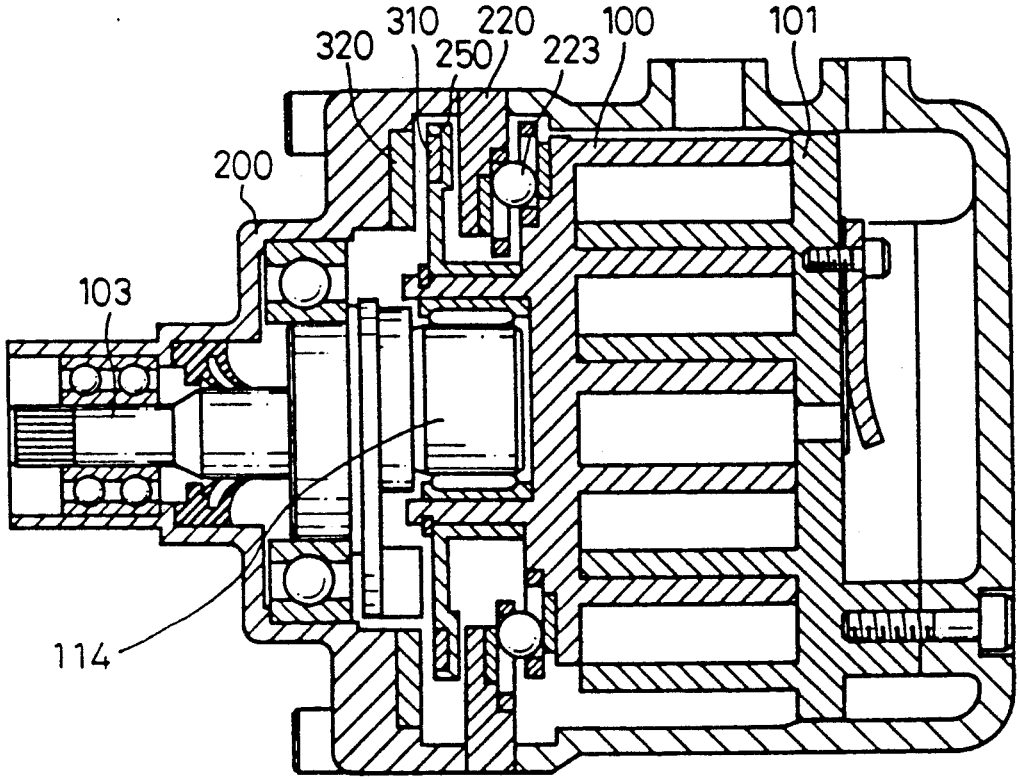
FIG. 8 is a sectional view showing a third embodiment.

FIG. 8 shows a third embodiment. As in the second embodiment, the holder 250 for the magnet 310 is also fixed to the moving scroll member 100 in this third embodiment, but the magnetic plate 320 is fitted on the inner surface of the front housing 200 in such a manner as to be opposite to the magnet holder 250.

Figure 9:
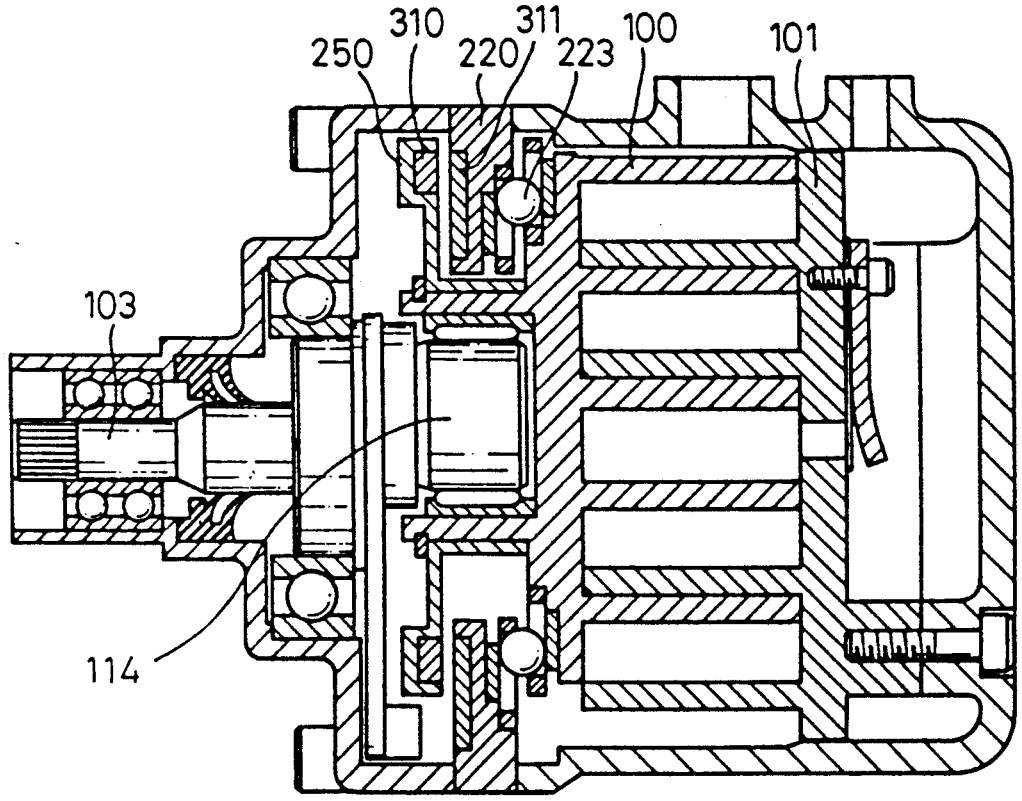
FIG. 9 is a sectional view showing a fourth embodiment.

FIG. 9 shows a fourth embodiment. The aforementioned first to third embodiments of the present invention utilize the attraction of the magnet, but in this fourth embodiment, the repulsion between the magnets is utilized to provide the same effect as in the first embodiment. To this end, a first magnet 310 is fixed to the holder 250 and a second magnet 311 is fixed to the opposite surface of the thrust bearing plate 220 to the holder 250, so that the surface opposite to the first magnet 310 will have a same polarity as that of the surface opposite to the holder 250. The remaining structure of this embodiment is similar to that of the first embodiment. In this embodiment, the first and second magnets 310 and 311 repulse each other, so that the moving scroll member 100 can be pressed toward the thrust bearing plate 220.

Figure 10:
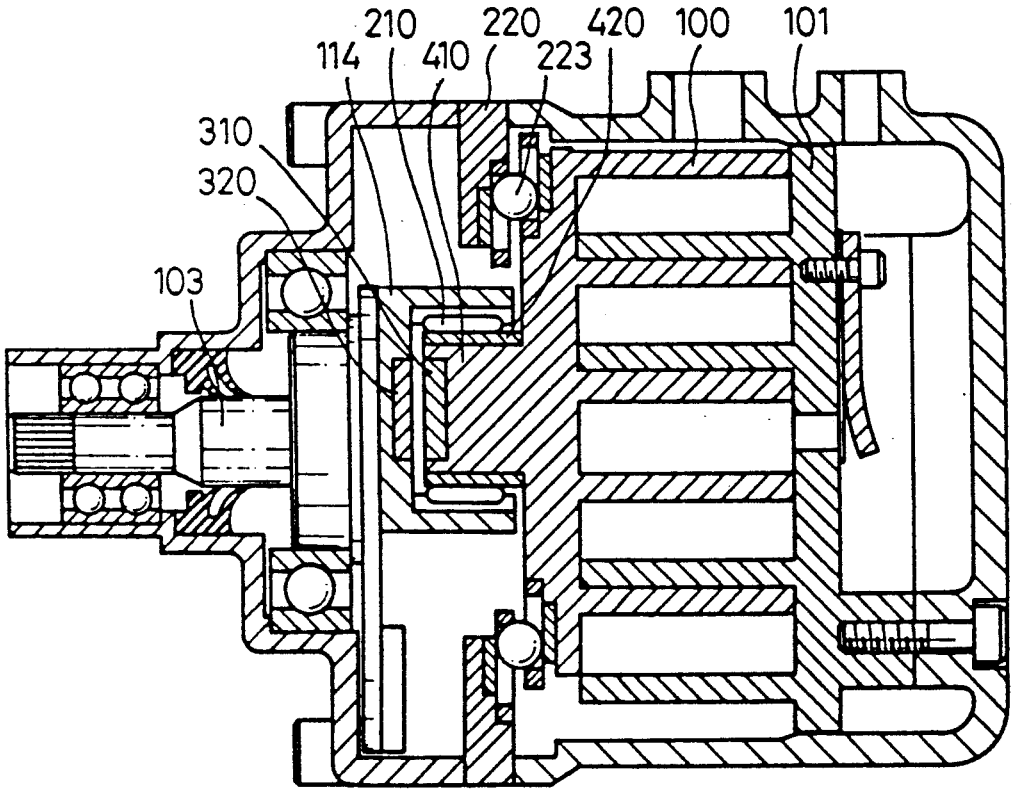
FIG. 10 is a sectional view showing a fifth embodiment.

FIG. 10 shows a fifth embodiment of the present invention. In this embodiment, the moving scroll member 100 has formed on the end face thereof on the side of the shaft 103 a boss 410 on which a ring 420 made of a bearing steel is fixed as fitted. The shaft 103 has a cylindrical crank 114 formed integrally therewith. The moving scroll member 100 is rotatably engaged in the crank 114 by the bearing 210. A magnet 310 is fixed to the boss 410 and the magnetic plate 320 is fixed to the crank 114.

The fifth embodiment also provides the same effect as the first embodiment. When the crank 114 in this fifth embodiment is made of a magnetic material, it is not necessary to provide the magnetic plate 320.

Figure 11:
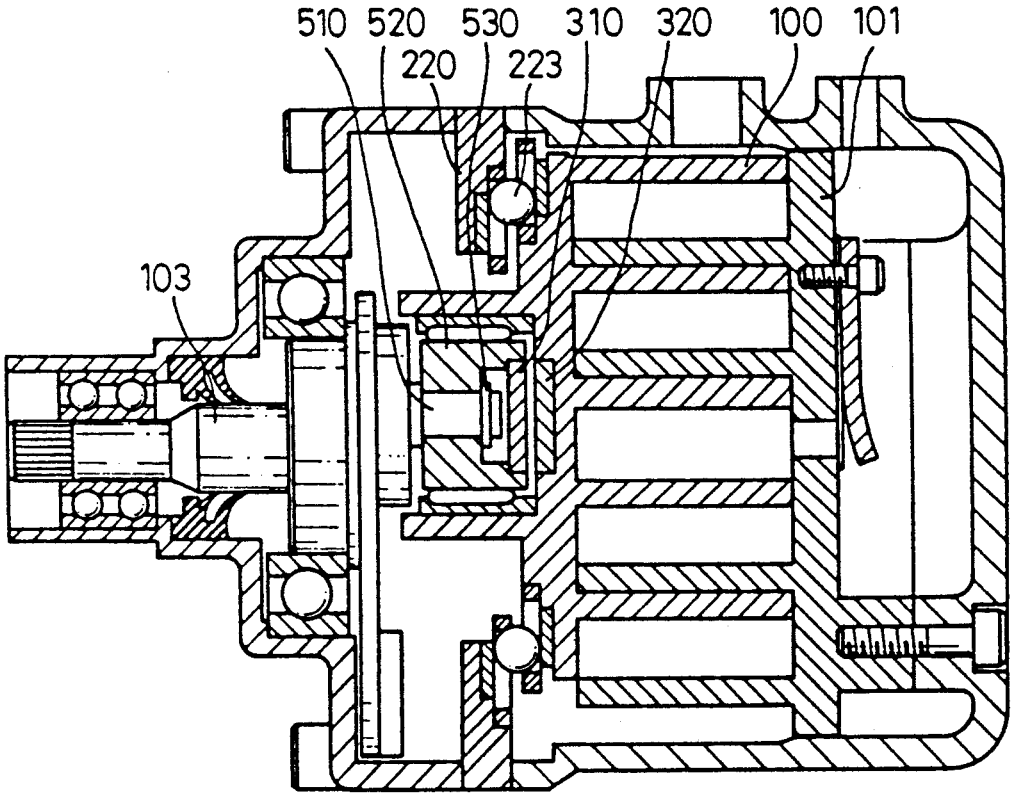
FIG. 11 is a sectional view showing a sixth embodiment.

FIG. 11 shows a sixth embodiment. In the previously described first embodiment, the crank 114 is formed integrally with the shaft 103, but the sixth embodiment can provide the same effect as the first embodiment even if the crank is separated from the shaft. Namely, in the sixth embodiment, the shaft 103 has formed integrally therewith and centrally offset therefrom a pin 510 to which a crank 520 is fixed by a clip 530.

Figure 12:
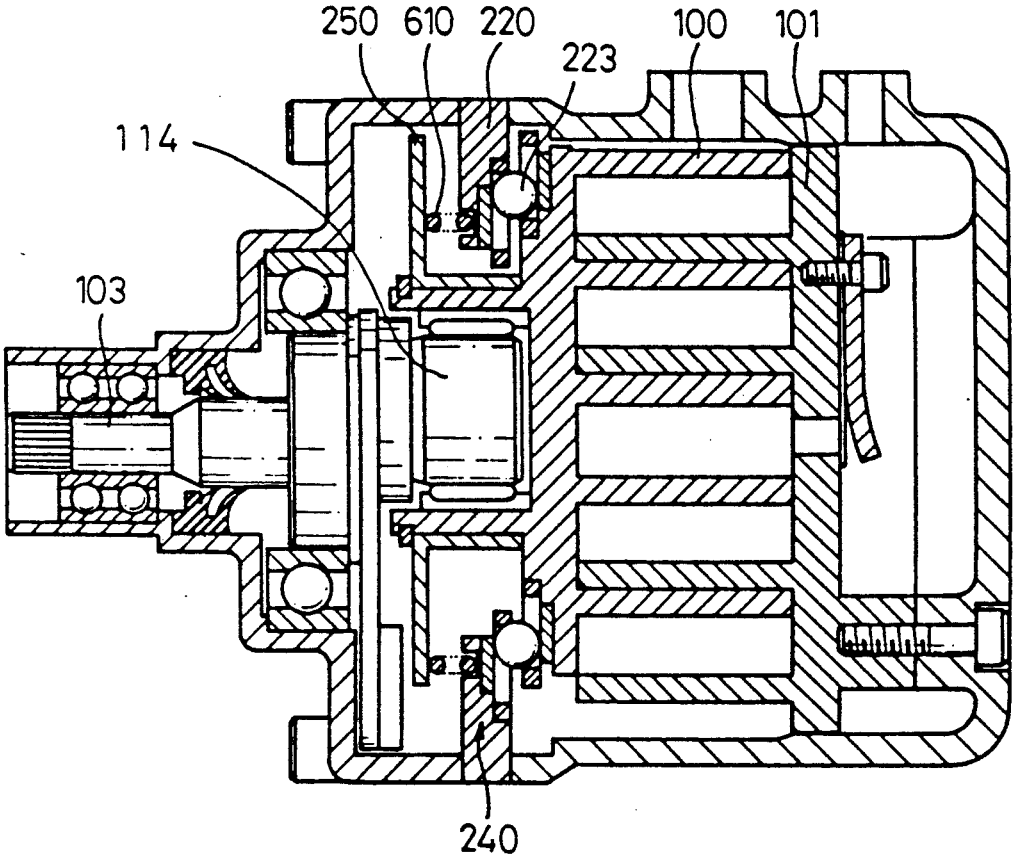
FIG. 12 is a sectional view showing a seventh embodiment.
Figure 13:
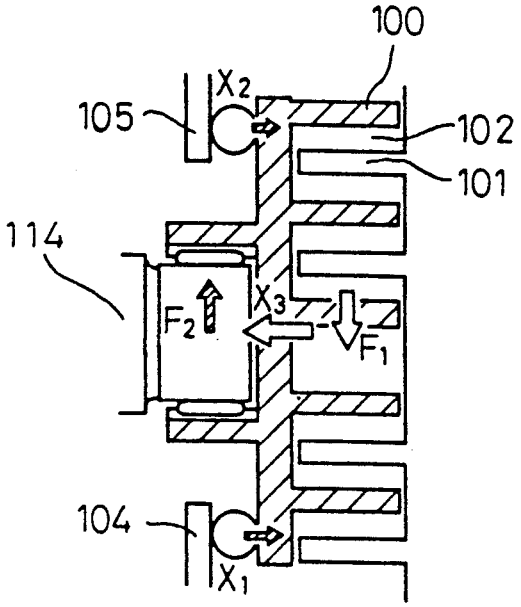
Fig.13 PRIOR ART
FIG. 13 is an explanatory drawing showing the compression reaction force and driving force, etc., in the conventional compressor.
Figure 14:
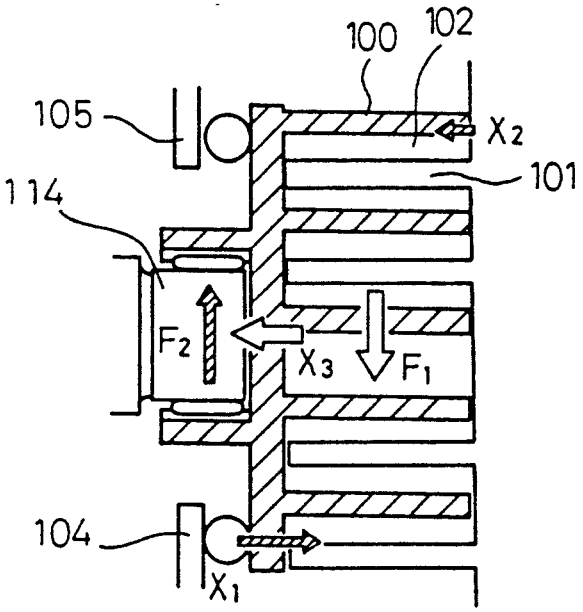
Fig.14 PRIOR ART
FIG. 14 is an explanatory drawing clarifying the problems of the conventional compressor.

FIG. 12 shows a seventh embodiment of the present invention. This embodiment is an example of the fourth embodiment (see FIG. 9) in which a spring is adopted in place of the magnets 310 and 311 which repulse each other. Namely, the seventh embodiment uses a compression spring 610 disposed between the thrust bearing plate 220 and holder 250 to press the moving scroll member 100 onto a thrust bearing member 240. The compression spring 610 is restrained from moving by a recess formed circumferentially of the thrust bearing plate 220 and moves relative to the holder 250. To minimize the sliding resistance between the compression spring 610 and holder 250, the holder 250 is surface-treated.

As in the seventh embodiment, the spring, when used appropriately, will work in the same way as the magnets. Namely, the magnets adopted in the other embodiments of the present invention may be replaced with a spring, to thus provide the same effect as in the first embodiment.

We claim:

1. A scroll compressor, comprising:

a housing with inlet and outlet ports, a stationary scroll member including a spiral body formed on an end plate thereof and fixed inside the housing, a moving scroll member including a spiral body formed on an end plate thereof and assembled so as to be in mesh with but centrally offset from said stationary scroll member, a front housing integrally mounted and covering an opening of said housing, a shaft rotatably supported in said front housing, having a crank centrally offset by a predetermined amount with respect to the center thereof and imparting a revolving movement to said moving scroll member, a detent mechanism allowing only revolving of said moving scroll member and inhibiting a rotation of said moving scroll member, thrust bearing members restricting a displacement of said moving scroll member in a direction away from said stationary scroll member, and magnetic means for pressing said moving scroll member axially against said thrust bearing members by a magnetic force and without contact.

2. A scroll compressor according to claim 1, wherein said magnetic means comprises at least a magnet and at least a magnetic body.

3. A scroll compressor according to claim 2, wherein a part of the components of the compressor also serves as the magnetic body of said magnetic means.

4. A scroll compressor according to claim 1, wherein said magnetic means comprises at least a pair of magnets which attract each other.

5. A scroll compressor according to claim 1, wherein said magnetic means comprises at least a pair of magnets which repulse each other.

6. A scroll compressor according to claim 1, wherein said magnetic means comprises an annular magnet and a magnetic flange.

7. A scroll compressor according to claim 1, wherein said magnetic means comprises a heavy duty magnet made of a rare earth material.

8. A scroll compressor according to claim 1, wherein a magnet provided on said crank side and a magnetic body provided on said moving scroll member side together form said magnetic means.

9. A scroll compressor according to claim 1, wherein a magnet provided on said moving scroll member side and a magnetic body provided on said crank side together form said magnetic means.

10. A scroll compressor according to claim 1, wherein said magnetic means is formed between said moving scroll member and said housing.

11. A scroll compressor according to claim 1, wherein said magnetic means includes a magnet fixed by bonding with an adhesive to a surface of said crank.

12. A scroll compressor according to claim 1, wherein said magnetic means includes a magnet fixed by a removable securing member to a portion of said moving scroll member.

13. A scroll compressor according to claim 1, wherein the magnetic means includes a magnet fixed indirectly, by a holder to a portion of said moving scroll member.

14. A scroll compressor according to claim 1, wherein an outside diameter of said housing is approximately 105 mm and a scroll tooth width of said moving and stationary scroll members is approximately 35 mm.

* * * * *